United States Patent [19]

Langlitz et al.

[11] Patent Number: 4,700,929

[45] Date of Patent: Oct. 20, 1987

[54] MOUNTING A METALLURGICAL VESSEL

[75] Inventors: Karlheinz Langlitz, Muelheim; Guenter Schnitz, Duisburg, both of Fed. Rep. of Germany

[73] Assignee: Mannesmann AG, Duesseldorf, Fed. Rep. of Germany

[21] Appl. No.: 712,407

[22] Filed: Mar. 15, 1985

[30] Foreign Application Priority Data

Mar. 24, 1984 [DE] Fed. Rep. of Germany ..... 3410949

[51] Int. Cl.[4] ..... C21C 5/42

[52] U.S. Cl. ..... 266/246; 266/247

[58] Field of Search ..... 266/247, 245, 246

[56] References Cited

U.S. PATENT DOCUMENTS

| | | | |
|---|---|---|---|
| 3,391,919 | 7/1968 | Eberhart | 266/246 |
| 3,684,265 | 8/1972 | Mühringer et al. | 266/246 |
| 4,195,824 | 4/1980 | Jansa et al. | 266/246 |
| 4,266,758 | 5/1981 | Schmitz | 266/246 |

FOREIGN PATENT DOCUMENTS

| | | | |
|---|---|---|---|
| 0040112 | 11/1981 | European Pat. Off. | 266/246 |

*Primary Examiner*—L. Dewayne Rutledge
*Assistant Examiner*—S. Kastler
*Attorney, Agent, or Firm*—Ralf H. Siegemund

[57] ABSTRACT

A metallurgical vessel is usually mounted in a annulus or the like by means of which the vessel can be tilted; however occasionally the vessel has to be removed from the annulus; accordingly a plurality of tension means are articulated by means of spherical bearings to the upper side of the annulus being comprised of a plurality of wires in the upper part with a hinge element and a tension head in the lower part; claw elements are affixed to the vessel and have lateral openings through which the tension head can be laterally inserted due to the articulation and/or the hinging; the head will lodge behind the claw element and can be tightened by means of a tension nut.

5 Claims, 7 Drawing Figures

MOUNTING A METALLURGICAL VESSEL

BACKGROUND OF THE INVENTION

The present invention relates to a metallurgical vessel particularly an exchangeable converter as used in steel making processes. The invention relates particularly to mounting a metallurgical vessel to a carrier annulus to which are connected coaxial tilt pins journaled in tilt mounts being arranged on support columns.

The suspension and tilting support of a metallurgical vessel of the type to which the invention pertains and including a full or partial carrier ring as mentioned may include for example tension elements being articulated to the upper side of the carrier ring and being displaceable in slots; the tension elements run through the carrier ring and are releasable connected to the vessel, generally in the area below the carrier ring and under utilization of a clamping head and a clamping nut for connection to a claw element or the like being secured the vessel itself. In addition load relief structure is to be provided to become effective whenever the vessel has been tilted into a horizontal disposition.

Suspension and fastening of a metallurgical vessel following the basic construction as outlined above serve primarily for permitting a support of the vessel with as little as possible heat induced tension being effective in the suspension. Mounting a vessel has in addition the advantage that the vessel remains connected with the ring through biased tension elements in any and all tilt position, so that there is no play and corresponding displacement between carrier and vessel.

German printed patent application No. 1,911,948 corresponding to U.S. Pat. No. 3,684,265 discloses the installation and removal of such a metallurgical vessel in such a manner that prior to release of the bias vessel is transfered to a vehicle provided for removal purposes and being placed underneath the vessel whenever a converter exchange is necessary. The vessel which may weigh between 200 and 1600 metric tons is subsequently lowered through a signicant level. The lifting or lowering stroke is determined essentially by particulars of the construction in the tilt mount bearing and the aforementioned support pillars. If the height of the arrangement generally is quite large one will need long stroke type lifting cylinders on the vessel exchange vehicle. Of course hydraulic cylinders with a long stroke are very expensive. On the other hand if only short stroke hydraulic lifting drives are used the problem arises that the vessel is no longer amenable for removal from its fastening structure from the carrier.

DESCRIPTION OF THE INVENTION

It is an object of the present invention to provide a new and improved construction for the tilt mount and suspension of metallurgical vessels particularly exchangeable steel converters under utilization of tension biased elements and load relief structure as provided between vessel and a carrier ring to accomodate horizontal vessel dispositions and under further accomodation of short lifting stroke type hydraulic lifting drives on a vessel exchange carriage or vehicle with the general objective in mind that the vessel exchange be simplified and reduced as to duration.

In accordance with the preferred embodiment of the present invention the object is attained by using tension elements which following the release of a clamping nut are laterally displaceable through open portions of the clamping jaws provided at the vessel for engagement with the head of the tension element. This feature permits the utilization of tension elements in an advantageous manner permitting also a reduced stroke of the lifting equipment in the vessel exchange carriage. This in turn means that such tension elements can be used also in conjunction with vessels which have a low disposition vis-a-vis factory floor. Furthermore vessels in older type steel works can be equiped with the inventive feature and they can be fastened by means of such tension elements in an easily exchangeable manner.

It is therefore suggested to mount a metallurgical vessel in a full or partial annulus or ring, the latter being in turn tiltably mounted by means of pins and stationary bearings, a plurality of tension means are articulated to the upper side of the annulus and traverse the annulus generally in down direction preferably in particular chambers thereof being generally open at the bottom. The vessel itself carries claw elements being affixed thereto but having a lateral opening through which the respective lower portion (head) of tension means above can be laterally inserted on account of the articulation of the tension means. The tension means moreover each have a head being part of the tenison means and lodging behind the respective claw element when inserted. The respective head is releasably tightened to the claw element by means of tension nut means. The spacing for the tilting and the spacing of the mounting pillars can be relatively small which is particularly advantageous when the invention is to be practiced in existing older steel works.

In furtherance of the invention it is suggested to use a partitioning of the chambers and the carrier annulus so as to provide cooling of the interior of the carrier ring in general. Open sides here facilitate removal of the tension elements from the claws. Disengagement of the tension elements from the claws is facilitated by articulating the upper side of the tension elements to the upper side of the carrier ring.

Another way of establishing in a simple manner a disengagement between tension elements and claw elements can be established through partitioning of the tension elements, basically into two longitudinal sections whereby the two sections can be regarded basically as interconnected through a further articulated joint or hinge element. Herein one can make sure that the requisite lifting height for the vessel particularly for disengaging the load relief for the horizontal vessel disposition will alway remain within the lifting stroke range that is necessary for causing the tension elements to disengage from the claw element. Also any geometric shape or tolerance deviations as between carrier ring or claws can be compensated in a particular favorable manner.

The hinged construction of a lower portion of the tension elements favors a construction according to which the upper portion of the tension element can be provided as flexible bundles of steel wire while the lower portion is basically of a solid construction terminating in the aformentioned hinge and on the other hand in a tension head carrying the tension nut.

The transmission of forces between tension element and claw can be further improved in that the tension nut is basically of a spherical or semispherical configuration arranged in a matching spherical bearing and the latter element is in effect the one that engages the claw element. Spherical construction of the upper bearing support of the tension elements is also a preferred feature.

DESCRIPTION OF THE DRAWINGS

While the specification concludes with claims particularly pointing out and distinctly claiming the subject matter which is regarded as a the invention, it is believed that the invention, the objects and features of the invention and further objects, features and advantages thereof will be better understood from the following description taken in connection with the accompanying drawings in which:

Figure 1:
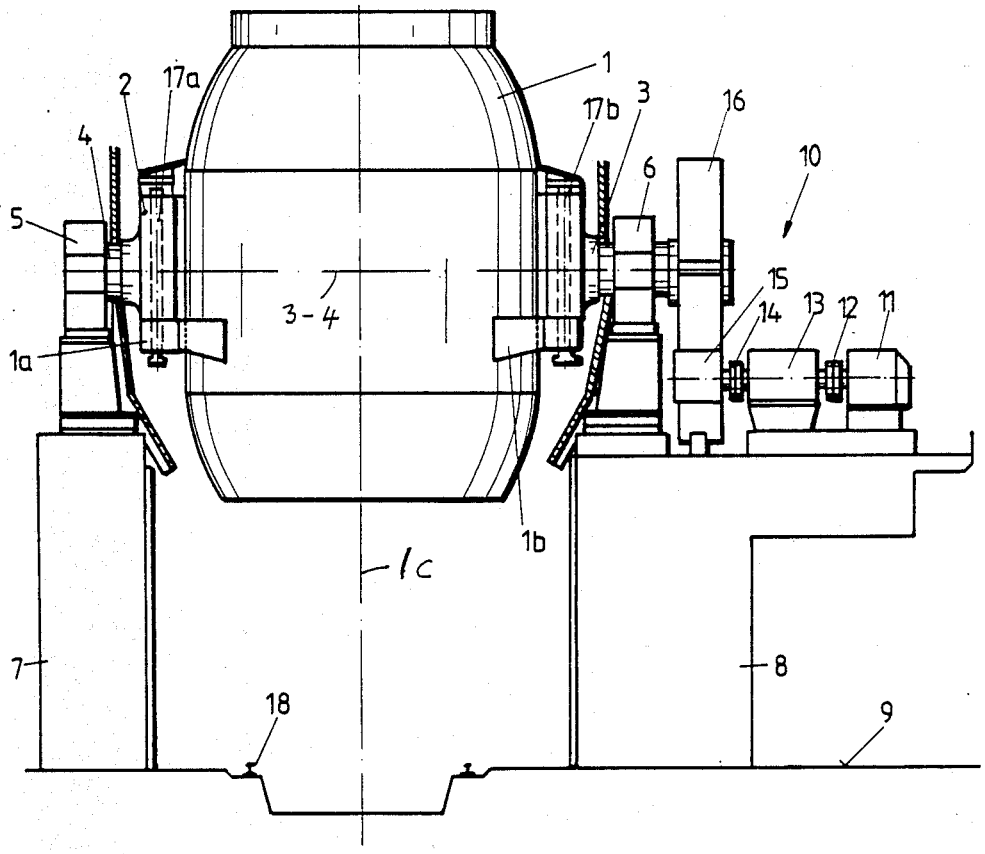
FIG. 1 illustrates a steel works converter with vessel fastening and mounting structure and tilt drive in a somewhat schematic front elevation and including structure in accordance with the preferred embodiment of the present invention for practicing the best mode thereof.

Proceeding now to the detailed description of the drawings, the figures show a metallurgical vessel 1 which is a steel works converter. The vessel 1 has an axis 1c and is carried by a partial carrier ring or annulus 2 i.e. the vessel 1 hangs in and bears against and upon the ring 2. The ring 2 itself is pivotably mounted by means of coaxial tilt pins 3 and 4 (tilt axis 3-4) extending into tilt mount bearings 5 and 6 which in turn rest on pillars or columns 7 and 8 and the latter are anchored to the floor 9 in the particular factory hall.

The vessel 1 will be tilted by means of a tilt drive 10. This drive is comprised of an electrical motor 11, a coupling 12, a clutch 13, another coupling 14, a gear 15, and a large gear wheel 16 meshing the gear 15. The vessel 1 can be tilted between an upright disposition as shown in FIG. 1 and any other tilt position i.e. the disposition can vary from 0–360 degrees, including therefore horizontal and upside down dispositions. In any of these tilt positions the vessel is connected in the carrier ring 2 by means of tension elements **17*a* and 17*b* being respectively associated in pairs and with both sides of the closed or horseshoe like carrier ring 2. The tension elements 17*a* and 17*b* extend normally parallel to the vessel axis 1c and they are tension biased by means of an appropriate biasing force as against the claws 1a and 1b** respectively.

Figure 2:
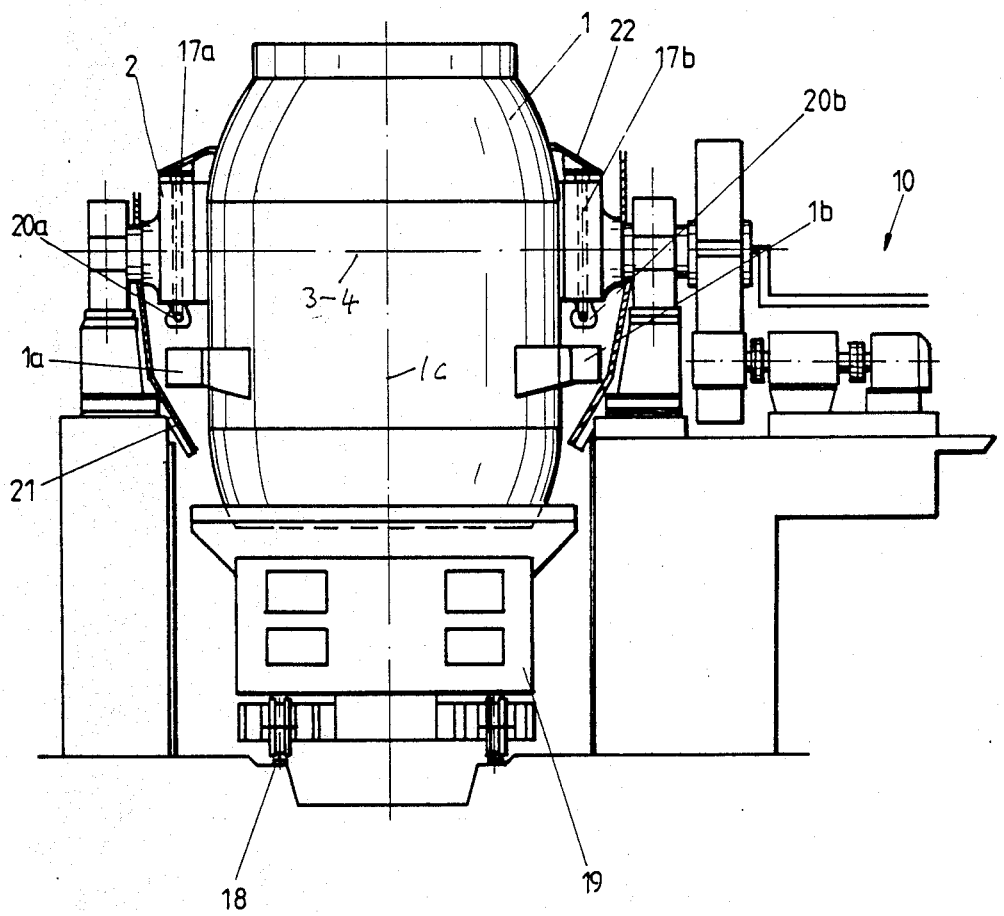
FIG. 2 illustrates the converter as shown in FIG. 1 but during a vessel exchange process and in conjunction with a vessel exchange carriage.
Figure 3:
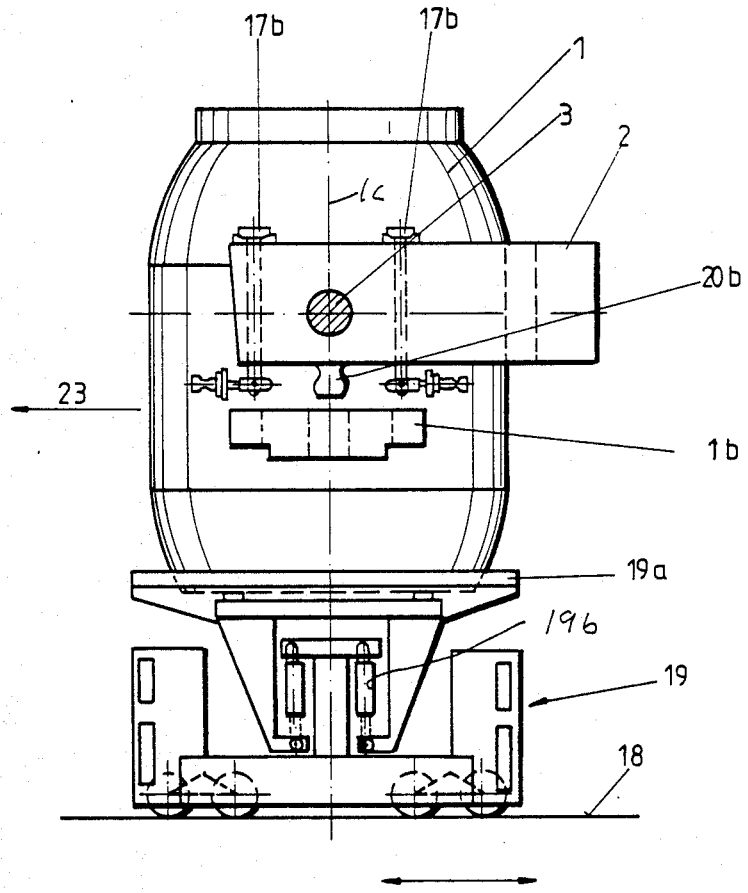
FIG. 3 illustrates still the same converter in the same view following a transfer of the vessel to the carriage but now in side elevation.

In between the column 7 and 8 runs a rail 18 for a vessel exchange carriage or vehicle 19 (FIGS. 2 and 3). The vessel 1 has been lowered in the disposition shown in FIG. 2 and is thus ready for movement by the carriage in the direction transverse to the drawings of FIGS. 1 and 2. If the carrier ring 2 is of a closed configuration then during the transfer of the vessel from the mounted disposition onto the vehicle or carriage 19, it will be obliquely tilted while the vessel 1 is lowered simultaneously after the tension elements **17*a* and 17*b* as well as load relief and receiving elements 20*a* and 20*b* have been removed from claws 1*a* and 1*b***.

After the carriage and vehicle 19 with vessel 1 thereon has been removed only the carrier ring 2 with tilt drive 10 remains in the converter stand including of course also the slag shield 21. A slag hood 22 is connected to the carrier ring 2 and likewise remains in the stand.

The instant of moving the vessel 1 on the carriage 19 is particularly illustrated in FIG. 3 and it is assumed that a horseshoe like ring carrier 2 is provided. The removal direction 23 therefore is also indicative of the movement of the vessel 1 out of the carrier 2 which of course requires the tension elements **17*a* and 17*b* to be disengaged from the claws 1*a* and 1*b*. The vehicle is provided with a lifting table 19*a* and has been lowered to its lowest position by a minimum stroke height under utilization of a hydraulic lifting system 19*b***. As compared with the known construction of a converter stand the invention permits saving in terms of lifting heights or stroke lengths by about 1200 mm so that presently only a 800 mm lifting height is necessary as compared with the lifting stroke in the past of about 2000 mm.

The tensioning and release of tension elements **17*a* and 17*b* is shown on an enlarged scale with reference to FIGS. 4–7. Each of the tension elements 17*a* and 17*b* is provided with a linkage or articulated joint 24 being moveable in three dimensions vis-a-vis the upper side 2*a* of the carrier ring 2. This joint 24 is comprised of a shell or receiver 25 with spherically shaped surface and a calotta shaped element 26 resting on receiver 25, an upper clamping head 27 is secured to element 26**.

Steel wires 28 are fastened to the head 27. These wires run essentially in parallel to the longitudinal axis 29 of the tension element particularly during normal operation and assembly, and they are connected to a solid body 30. The steel wires 28 constitute the upper longitudinal portion 31 and the solid body in parts establishes a lower longitudial portion 32 of the tension element or structure **17*a*. The structure for tension element 17*b*** is analogously configured.

The solid body 30 is established through a three dimensionally movable articulate hinge 33, a lower clamping head 34 and the tension nut 35. The ball shaped tension nut 35 is mounted in the ball shaped calotta 36. In order to transmit the tension biasing force for initial adjustment and installation a tension member 37 is provided in the lower clamping head 34. The biasing device itself is not illustrated. There are two tension elements **17*a* and two elements 17*b* respectively extending to both sides of the tilt axis 3 - 4**.

After release of the tension nut 35 the tension elements **17*a* and 17*b* i.e. the assembly of wires and solid bodies can be laterally removed through openings or indents 38 of claws 1*a*, 1*b*, which indents are opened to one side and permit displacement of the respective tension elements 17*a* or 17*b* transversely to the direction of extension, axis 29, so as to disengage them from the jaw element 1*a* or 1*b* as the case may be. The entire arrangement is preferably oriented such that the direction of removal coincides generally with the direction 23 of removal of the vesssel from the holding ring. Observing this feature is advantageous for applying the invention to existing and older versions of steel works wherein particularly the respective tilt mounts 6 corresponding to tilt mount 5 and 6 and their respective support column 7 and 8** are fairly closely spaced.

Figure 4:
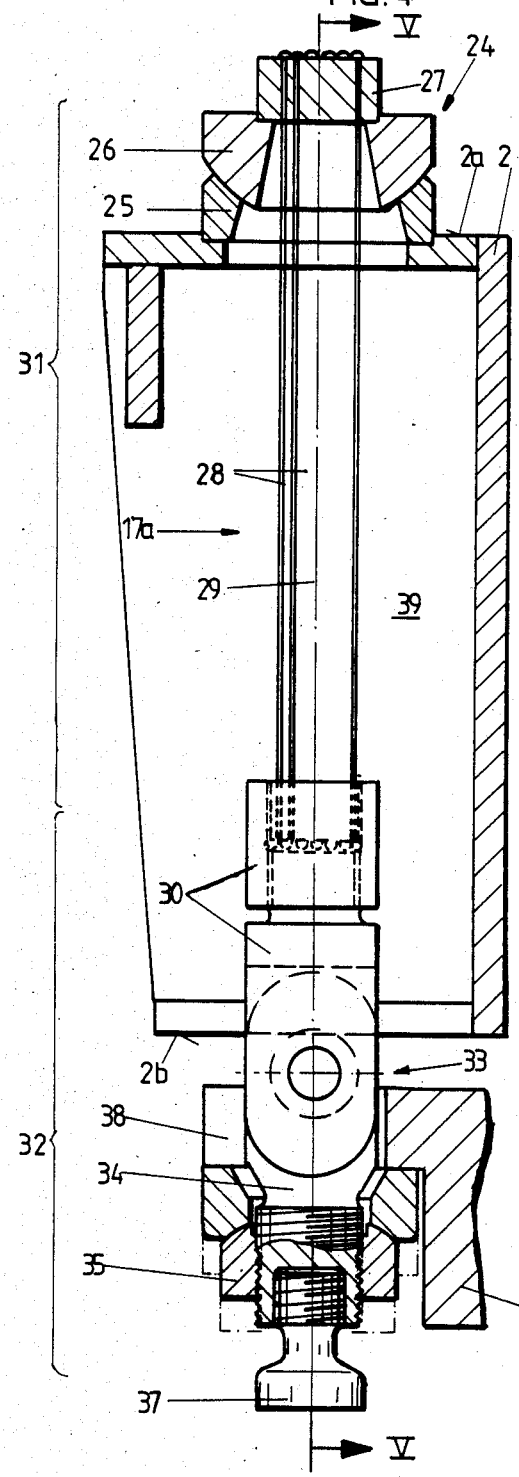
FIG. 4 is a vertical section view through the carrier ring of the vessel shown in FIGS. 1–3 showing tension elements and claws in operating disposition for the vessel, the fig. is drawn to an enlarged scale as compared with FIGS. 1–3.
Figure 5:
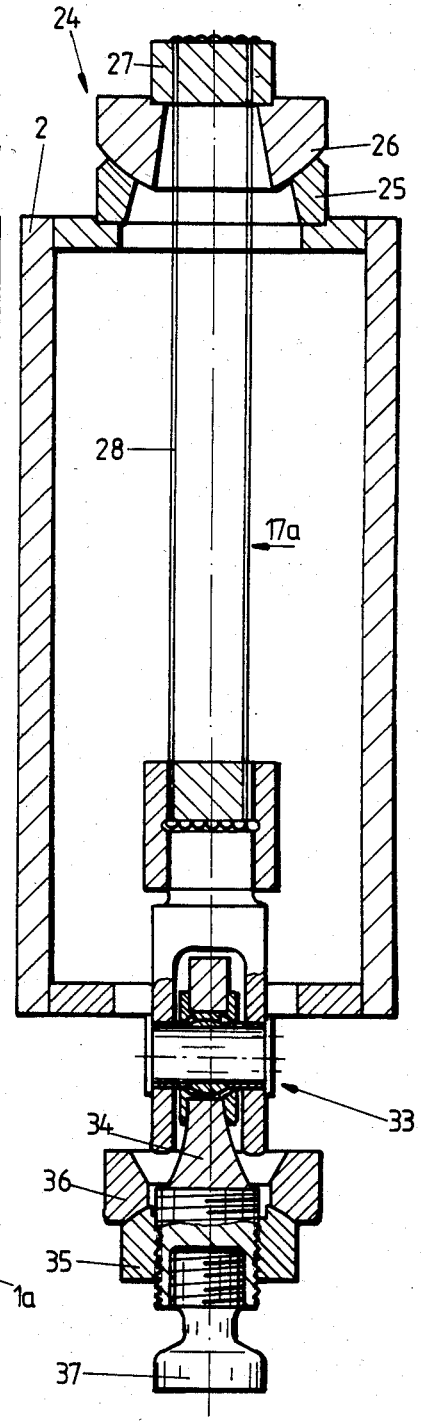
FIG. 5 is a longitudinal cross section as indicated by V—V in FIG. 4 but the jaw has been omitted.
Figure 6:
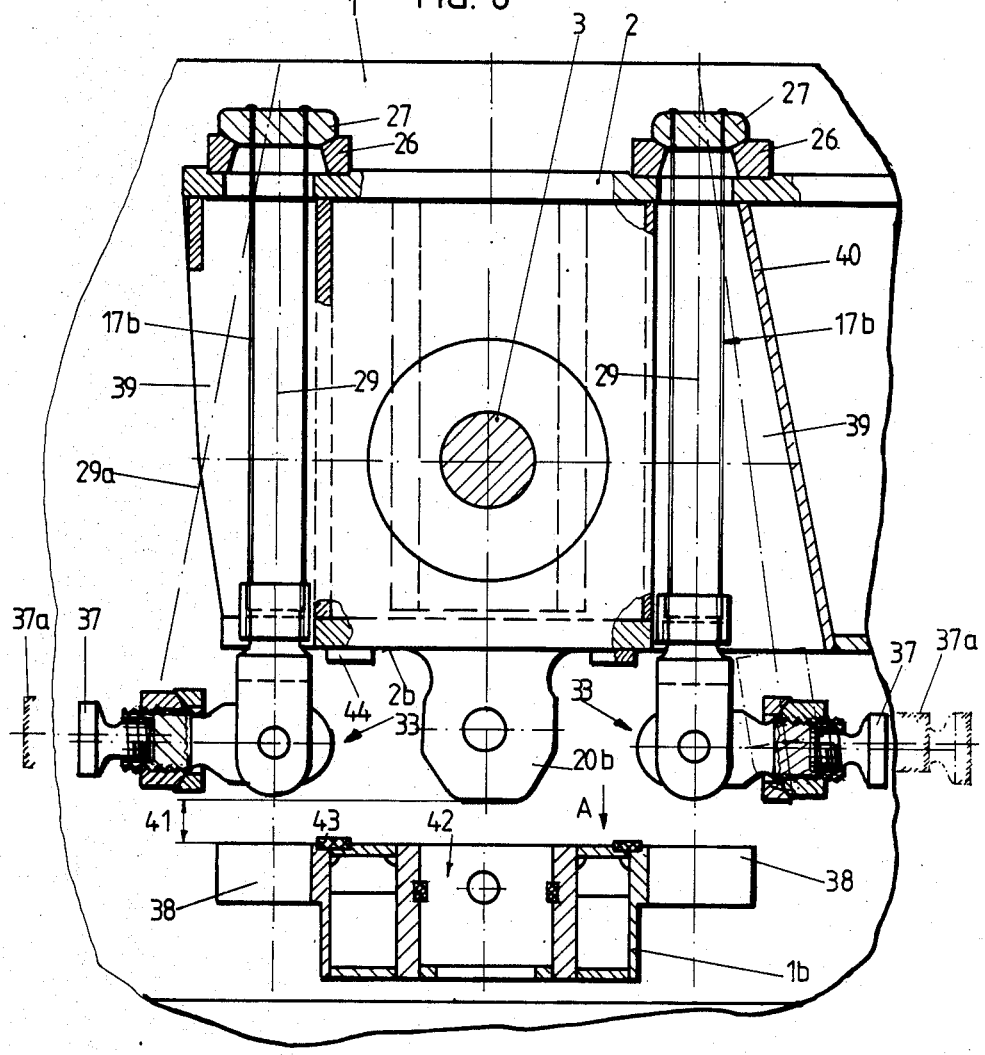
FIG. 6 is a partial view of the carrier ring the vessel with jaw and tension elements but disengaged from the jaw.
Figure 7:
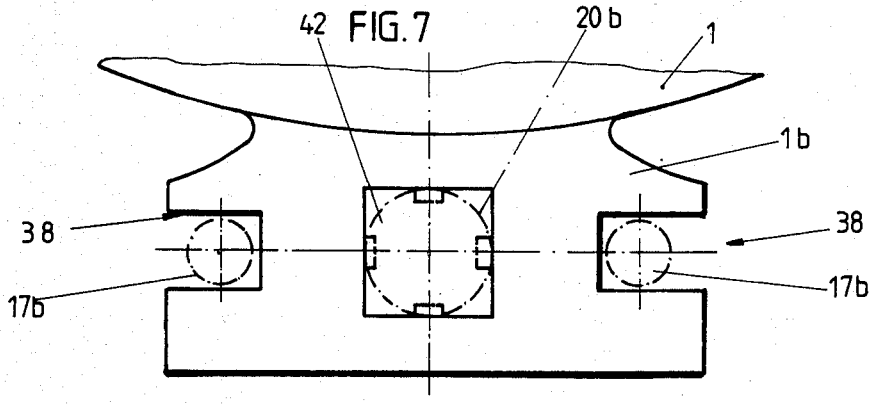
FIG. 7 is a top elevation as seen in the direction A indicated in FIG. 6.

The sequence of movement is preferably such that the tension elements 17*a* and 17*b* are pivoted inside the chamber or chambers 39 inside carrier ring 2 whereby particularly close to the underside 2*b* of this carrier ring the chambers 39 are open as can be seen from FIG. 5. In FIG. 4 the displacement of the tension elements 17*a* is to the left corresponding to a movement as per FIG. 5 transversely to the plane of that drawing. In either case the tension elements are pivoted about the upper articulated joints 24. The chamber 39 may be provided with a wall or partition 40 (FIG. 6, right hand portion) so as to limit the pivot range of the respective tension elements. Also as per FIG. 6 in this instance vessel 1 with the claw 1*b* shown here is already lowered to such an extent that the removal position as per FIG. 3 is already obtained. The free space 41 is correspondingly quite small in direct relation to the small lifting stroke which the inventive feature permits.

Upon inserting a vessel 1 the tension element, as seen through the longitudinal axis 29, has been pivoted to a position 29*a*. In addition hinge joint 33 is tilted to a bent-off position. In such an instance the tension member 37 are in the dash/hatched position 37*a*. In this phase and upon returning this or another vessel 1 there will at first be an introduction of the load relief pin 20*b* (for a horizontal disposition of the vessel) into the pocket 42 of the respective claw such as 1*b* in FIG. 6. Thus it is advantageous that the load relief and support element 20*b* assumes a second function, namely it serves as a centering device for placement of the vessel. Following these operations the vessel 1 will be lifted by means of the vessel support 43 towards corresponding counter supports 44 in the carrier ring 2 until engagement occurs as between 43 and 44 whereupon the tension elements 17*a* and 17*b* are pivoted into the straight down position and the hinge 33 is folded back to a full alignment of all parts of the tension element with axis 29. Next the tension bias is applied through tension members 37 while the tension nut 35 is tightened to releave the tension member 37 from the tension force. Subsequently the tension is imparted upon the tension elements 17*a* and 17*b*.

The invention is not limited to the embodiments described above but all changes and modifications thereof, not constituting departures from the spirit and scope of the invention, are intended to be included.

We claim:

1. The mounting of a metallurgical vessel in a full or partial ring being in turn tiltably mounted by means of pins pivotably held in stationary bearings, comprising:

a plurality of tension means articulated to the upper side of the ring and transversing the ring generally in a direcition parallel to the axes of the vessel;

a plurality of claw elements affixed to the vessel and each having a lateral opening, the lower portion of the respective tension means being situated and held in the opening after having been laterally inserted due to said tension means being articulated; and tension head means being part of the respective tension means for lodging behind the respective claw elements to thereby hold said tension means when inserted there being tension nut means for releasably tightening the respective tension head to the respective claw element.

2. Mounting of a metallurgical vessel as in claim 1 said annulus having chambers being in parts laterally and open at the bottom.

3. Mounting of a metallurgical vessel as in claim 1 wherein said tension means include tension wires and a solid body in the lower part.

4. Mounting of a metallurgical vessel as in claim 3 wherein the solid portion of each tension means includes a hinge for pivoting independently from pivoting of the tension means as a whole.

5. Mounting of a metallurgical vessel as in claim 1 wherein the tension head includes in addition a spherical bearing arrangement for articulating the lower portion of the tension means vis-a-vis the respective claw element.

* * * * *